US008480822B2

(12) United States Patent
Kohlmann

(10) Patent No.: US 8,480,822 B2
(45) Date of Patent: Jul. 9, 2013

(54) ALUMINUM ALLOY

(75) Inventor: Peter Kohlmann, Limbach/Baden (DE)

(73) Assignee: Rheinfelden Alloys GmbH & Co. KG, Rheinfelden (DE)

( * ) Notice: Subject to any disclaimer, the term of this patent is extended or adjusted under 35 U.S.C. 154(b) by 0 days.

(21) Appl. No.: 13/203,755

(22) PCT Filed: Mar. 3, 2010

(86) PCT No.: PCT/EP2010/052715

§ 371 (c)(1),
(2), (4) Date: Aug. 29, 2011

(87) PCT Pub. No.: WO2010/100204

PCT Pub. Date: Sep. 10, 2010

(65) Prior Publication Data

US 2012/0009081 A1 Jan. 12, 2012

(30) Foreign Application Priority Data

Mar. 6, 2009 (EP) ..... 09405042

(51) Int. Cl.
*C22C 21/04* (2006.01)

(52) U.S. Cl.
USPC ..... 148/437; 420/548; 420/549

(58) Field of Classification Search
USPC ..... 148/437; 420/548, 549
See application file for complete search history.

(56) References Cited

U.S. PATENT DOCUMENTS

2005/0163647 A1 7/2005 Donahue et al.

FOREIGN PATENT DOCUMENTS

| | | | |
|---|---|---|---|
| EP | 0 687 742 | A1 | 12/1995 |
| EP | 1 331 281 | A1 | 7/2003 |
| EP | 1 683 881 | A1 | 7/2006 |
| JP | 04168241 | A * | 6/1992 |

* cited by examiner

*Primary Examiner* — Roy King
*Assistant Examiner* — Janelle Morillo
(74) *Attorney, Agent, or Firm* — The Webb Law Firm

(57) ABSTRACT

The invention relates to an aluminum alloy having good electrical conductivity and good thermal conductivity for producing die-cast components, containing: 8.0 to 9.0 wt % silicon, 0.5 to 0.7 wt % iron, max. 0.010 wt % copper, max. 0.010 wt % magnesium, max. 0.010 wt % manganese, max. 0.001 wt % chromium, max. 0.020 wt % titanium, max. 0.020 wt % vanadium, max. 0.05 wt % zinc, 0.010 to 0.030 wt % strontium, and aluminum as the rest, with further elements and manufacturing-caused impurities individually max. 0.05 wt %, in total max. 0.2 wt %. The alloy is suited in particular for producing components having good electrical conductivity and good thermal conductivity in the die casting process.

4 Claims, No Drawings

ALUMINUM ALLOY

The invention relates to an aluminum alloy having good electrical conductivity and good thermal conductivity for producing die-cast components.

The standardized alloy LM 6 in accordance with BS 1490 (AC 47000, AlSi12(Cu)) is routinely used for components having good electrical conductivity and good thermal conductivity produced by die casting, for example as cooling elements used as covering for the electronics in automobiles.

It is an object of the invention to provide an aluminum alloy which is suitable for die casting and has an improved electrical conductivity and thermal conductivity compared to the alloys known from the prior art.

The object of the invention is achieved by the alloy containing from 8.0 to 9.0% by weight of silicon
from 0.5 to 0.7% by weight of iron
not more than 0.010% by weight of copper
not more than 0.010% by weight of magnesium
not more than 0.010% by weight of manganese
not more than 0.001% by weight of chromium
not more than 0.020% by weight of titanium
not more than 0.020% by weight of vanadium
not more than 0.05% by weight of zinc
from 0.010 to 0.030% by weight of strontium and aluminum as balance with further elements and production-related impurities of not more than 0.05% by weight each, in total not more than 0.2% by weight.

In a preferred variant of the alloy of the invention, the sum of the elements manganese, titanium, vanadium and chromium is ≦0.02% by weight.

A preferred field of application for the aluminum alloy of the invention is the production of components having good electrical conductivity and good thermal conductivity, for example cooling elements for electronic components, by die casting.

Further advantages, features and details of the invention are indicated in the following description of a preferred example and with the aid of two comparative examples.

The alloy A according to the invention and two comparative alloys B and C having the compositions indicated in Table 1 were cast by die casting starting from a melt temperature of 660° C. at a mold temperature of 150° C. to produce cooling elements for electronic components having a weight of 2.2 kg. After removal from the die casting mold, the specimens were cooled in static air.

The electrical conductivity was measured at two different measurement points M1 and M2 on the die-cast components. The results shown in Table 2 demonstrate the superiority of the alloy A according to the invention over the comparative alloys B and the registered standard alloy C (LM6 in accordance with BS 1490, AC 47000, AlSi12(Cu)). The comparative alloy B differs from the alloy A according to the invention essentially in that the silicon content is higher.

Table 3 shows the results of thermal conductivity measurements on the die-cast components made of the alloy A according to the invention and the comparative alloy C. Compared to the comparative alloy C, the alloy A according to the invention displays a thermal conductivity which is from 30 to 40% higher.

TABLE 1

Chemical composition of the alloys in % by weight

| Alloy | Si | Fe | Cu | Mg | Mn | Cr | Ti | V | Sr |
|---|---|---|---|---|---|---|---|---|---|
| A | 8.66 | 0.60 | 0.006 | 0.001 | 0.005 | 0.001 | 0.008 | 0.006 | 0.012 |
| B | 9.40 | 0.63 | 0.008 | 0.001 | 0.006 | 0.001 | 0.008 | 0.006 | 0.008 |
| C | 10.0-13.0 | 0.6 | 0.1 | 0.10 | 0.5 | — | 0.2 | — | — |

TABLE 2

Electrical conductivity

| Alloy | Measurement point M1 [m/Ωmm$^2$] | Measurement point M2 [m/Ωmm$^2$] |
|---|---|---|
| A | 26.06 | 24.48 |
| B | 24.35 | 23.09 |
| C | 22.08 | 21.21 |

TABLE 3

Thermal conductivity

| Alloy | Number of measurements | Temperature [° C.] | Specimen thickness [mm] | Thermal conductivity [W/mK] |
|---|---|---|---|---|
| A | 5 | 23 | 5.76 | 169.4 |
| C | 5 | 23 | 3.96 | 119.1 |

The invention claimed is:

1. An aluminum alloy having electrical conductivity and thermal conductivity that are greater than the electrical conductivity and thermal conductivity of LM6 in accordance with BS 1490, for producing die-cast components, characterized in that the alloy contains from 8.0 to 9.0% by weight of silicon
from 0.5 to 0.7% by weight of iron
not more than 0.010% by weight of copper
not more than 0.010% by weight of magnesium
not more than 0.010% by weight of manganese
not more than 0.001% by weight of chromium
not more than 0.020% by weight of titanium
not more than 0.020% by weight of vanadium
from 0.010 to 0.030% by weight of strontium and aluminum as balance with further elements and production-related impurities of not more than 0.05% by weight each, in total not more than 0.2% by weight.

2. The aluminum alloy as claimed in claim 1, characterized in that the sum of the elements manganese, titanium, vanadium and chromium is ≦0.02 by weight.

3. A die-cast component composed of an aluminum alloy as claimed in any of claims 1 to 2.

4. The component of claim 3, wherein the component is a cooling element for electronic components.

* * * * *

UNITED STATES PATENT AND TRADEMARK OFFICE

CERTIFICATE OF CORRECTION

PATENT NO. : 8,480,822 B2
APPLICATION NO. : 13/203755
DATED : July 9, 2013
INVENTOR(S) : Peter Kohlmann It is certified that error appears in the above-identified patent and that said Letters Patent is hereby corrected as shown below:

In the Claims

Column 2, Line 54, Claim 2, delete "≤0.02" and insert -- ≤0.02% --

Signed and Sealed this
Twenty-fourth Day of December, 2013

Margaret A. Focarino

Margaret A. Focarino
*Commissioner for Patents of the United States Patent and Trademark Office*